US008939509B2

(12) United States Patent
Ni

(10) Patent No.: US 8,939,509 B2
(45) Date of Patent: Jan. 27, 2015

(54) CHAIR CHASSIS

(71) Applicant: Hangzhou Zhongtai Industrial Group Co., Ltd., Hangzhou, Zhejiang (CN)

(72) Inventor: Yong-Xing Ni, Hangzhou (CN)

(73) Assignee: Hangzhou Zhongtai Industrial Group Co., Ltd., Hangzhou, Zhejiang (CN)

( * ) Notice: Subject to any disclaimer, the term of this patent is extended or adjusted under 35 U.S.C. 154(b) by 44 days.

(21) Appl. No.: 13/860,990

(22) Filed: Apr. 11, 2013

(65) Prior Publication Data

US 2014/0306503 A1 Oct. 16, 2014

(51) Int. Cl.
*A47C 1/032* (2006.01)

(52) U.S. Cl.
CPC ..... *A47C 1/03272* (2013.01)
USPC ..... 297/303.4; 297/300.5; 297/300.8; 297/302.4

(58) Field of Classification Search
USPC ..... 297/300.5–300.8, 301.3, 301.7, 302.4, 297/303.4
See application file for complete search history.

(56) References Cited

U.S. PATENT DOCUMENTS

| | | | | |
|---|---|---|---|---|
| 5,042,876 | A * | 8/1991 | Faiks | 297/303.4 |
| 5,328,237 | A * | 7/1994 | Yamaguchi et al. | 297/303.4 |
| 6,945,603 | B2 * | 9/2005 | Elzenbeck | 297/303.4 |
| 7,014,262 | B2 * | 3/2006 | Rossetto et al. | 297/300.8 |
| 7,080,884 | B2 * | 7/2006 | Daeschle et al. | 297/303.4 |
| 7,147,285 | B2 * | 12/2006 | Lin | 297/301.1 |
| 7,530,637 | B1 * | 5/2009 | Wu | 297/300.5 |
| 7,766,426 | B2 * | 8/2010 | Meidan | 297/303.4 |
| 7,866,749 | B2 * | 1/2011 | Costaglia et al. | 297/300.5 |
| 2003/0001417 | A1 * | 1/2003 | Moreschi | 297/300.5 |

* cited by examiner

*Primary Examiner* — Peter Brown
(74) *Attorney, Agent, or Firm* — Muncy, Geissler, Olds & Lowe, P.C.

(57) ABSTRACT

A chair chassis includes a base, a warped plate, a first adjustment member and a second adjustment member. The base including an upper cover, a lower cover and a front cover is arranged at a bottom surface of a seat of a chair. The warped plate is disposed under the upper cover of the base for connecting to a seat back of the chair. Two compression springs arranged in parallel with a certain interval are disposed between the first adjustment member and the warped plate for adjusting travel distance of the compression springs and changing a force of the seat back. The second adjustment member is used for lifting the chair by rotation of a second adjustment shaft. The chair chassis is fastened and adjusted by operating the second adjustment shaft to move along an axial direction. The chair chassis has simple structure, easy operation and improved applicability.

10 Claims, 6 Drawing Sheets

CHAIR CHASSIS

BACKGROUND OF THE INVENTION

1. Fields of the Invention

The present invention relates to a chair chassis, especially to a chair chassis by which a force of a seat back can be adjusted. Moreover, lifting and fastening of the chair chassis are adjusted by the same handle. The vibration and friction generated during inclining of the seat back are also reduced. The operation and adjustment of the chair chassis are easier and faster.

2. Descriptions of Related Art

Generally, a chair chassis includes a plurality of components such as an upper support tray, a lower support rod, a shaft, springs, etc. The upper support tray is fixed with and connected to a chair back so that the chair back is adjusted and reclined to different angles around the shaft to make users feel more comfortable. However, the springs used in the chair chassis are torsion spring. During the adjustment process, the force of the torsion spring is unable to be adjusted so that its applicability is limited. Moreover, users need to pull a handle by using a lot of effort while in use. When the chair back is reclined, noises are created due to friction of a brake part. And once the chair back is turned back quickly, users sense the vibration of the chair chassis and feel uncomfortable. Furthermore, a fastening handle and a lift handle of the chair are separated. Thus the adjustment of fastening position and lift range of the chair is inconvenient. There is room for improvement and a need to provide a novel chair chassis.

SUMMARY OF INVENTION

Therefore it is a primary object of the present invention to provide a chair chassis whose lift range and fastening position can be adjusted. A force of a seat back can also be adjusted by the chair chassis.

In order to achieve the above object, a chair chassis of the present invention includes a base, a warped plate, a first adjustment member and a second adjustment member. The base is composed of an upper cover, a lower cover and a front cover. The upper cover is connected to a seat of a chair. The lower cover is disposed under the upper cover and connected to legs of the chair. The front cover is connected to and located between a front end of the upper cover and a front end of the lower cover. The warped plate is disposed under the upper cover of the base and is used for connecting a seat back of the chair.

Two compression springs are arranged in parallel with a certain interval and disposed between the first adjustment member and the warped plate. The first adjustment member consists of a first adjustment shaft, a drive wheel, a driven wheel and an adjustment nut. An inner end of the first adjustment shaft is passed through the left side or right side of the base from outside to inside while an outer end of the first adjustment shaft is connected to a first handle. The drive wheel is connected to the inner end of the first adjustment shaft. The driven wheel includes a gear part engaged with the drive wheel, and a screw shaft part whose top end is tilted toward the warped plate. The adjustment nut is threaded around the screw shaft part of the driven wheel and is against one end of each compression springs while the other end of each compression springs is against the rear end of the lower cover of the base. The first adjustment member is operated for adjusting the travel distance of the compression spring and further changing the force of the seat back. The second adjustment member includes a second adjustment shaft, a lift adjustment part, and a range adjustment part. An inner end of the second adjustment shaft is inserted through one side of the base opposite to the side disposed with the first adjustment shaft of the first adjustment member, from outside to inside while an outer end of the second adjustment shaft is connected to a second handle. The lift adjustment member includes a lift adjustment block that is sleeved on the inner end of the second adjustment shaft, a lift pull rod having one end connected to the lift adjustment block, and a lift block that is connected to the other end of the lift pull rod. The range adjustment part consists of a torsion spring having one end connected to an inner end of the second adjustment shaft, a pull rod connected to the other end of the torsion spring, and a fastening piece connected to the other end of the pull rod. Moreover, the warped plate is disposed with a plurality of insertion holes arranged at intervals vertically. The second adjustment member is operated (such as rotating and pulling) so as to adjust lift range and fastening position of the chair chassis respectively.

For adjusting force of the seat back, the warped plate remains still. The first handle of the first adjustment member is rotated first for driving the first adjustment shaft, the drive wheel and the driven wheel to work. Thus the adjustment nut is moved along the screw shaft part of the driven wheel inclinedly and vertically to compress/stretch the compression spring and change travel distance of the compression spring. Therefore the spring force of the compression springs is adjusted and the adjustment of the force of the seat back is also achieved.

While lifting the chair, the lower plate of the base keeps still. The second handle of the second adjustment member is rotated first to drive the second adjustment shaft and the lift adjustment block of the lift adjustment member to rotate. Then the lift block is driven to rotate through the lift pull rod so as to complete height adjustment.

For adjusting the fastening position, the lower cover of the base keeps still. The second handle of the second adjustment member is operated to move outward/or inward for driving the second adjustment shaft, rotating the torsion spring and driving the pull rod to make the fastening piece move out of/or in the insertion hole of the warped plate. When the fastening piece is moved out of one of the insertion holes, the warped plate 20 is in a released state. While the fastening piece being moved into one of the insertion holes, the warped plate is in a fastened state. The adjustment of the fastening position of the chair chassis is completed.

DETAILED DESCRIPTION OF THE PREFERRED EMBODIMENT

Figure 1:
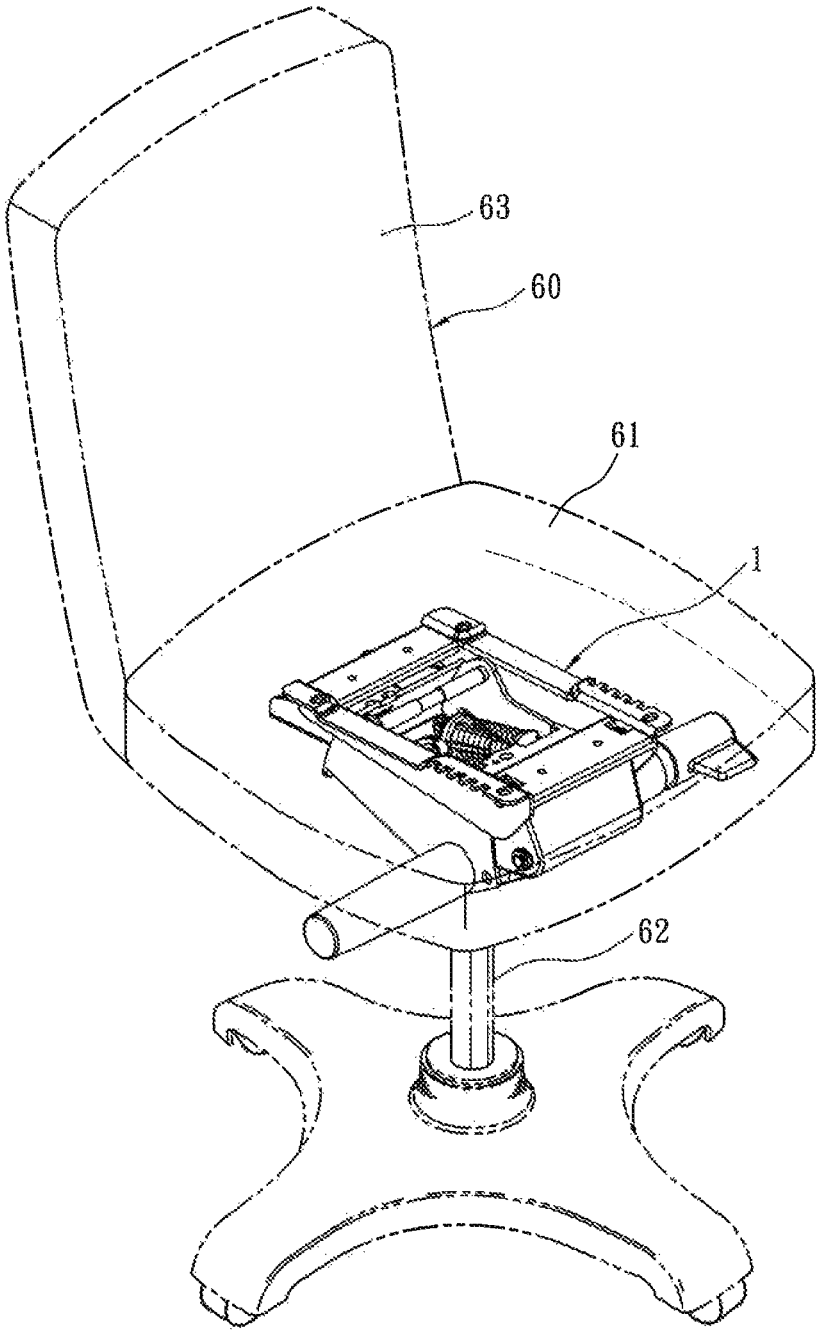
FIG. 1 is a schematic drawing showing an embodiment of a chair chassis being fastened on a seat of a chair according to the present invention.
Figure 2:
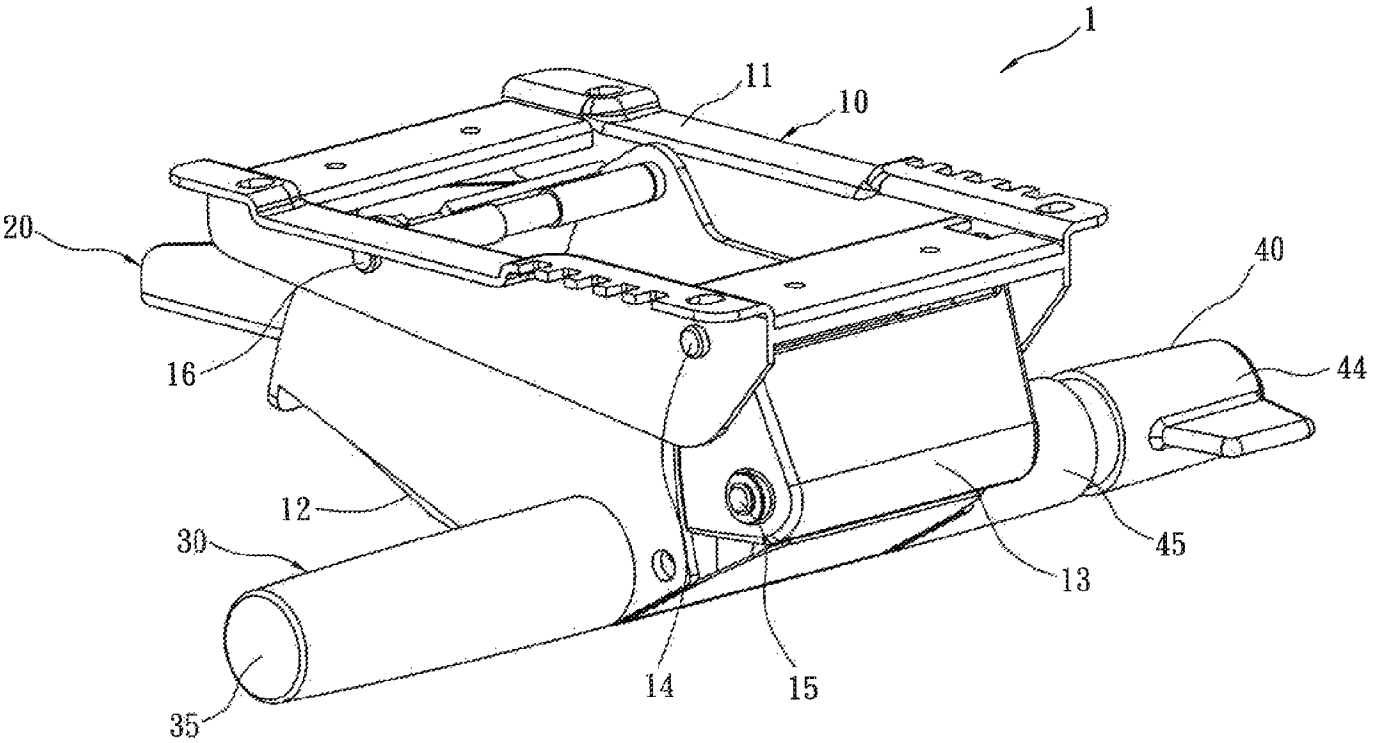
FIG. 2 is a perspective view of an embodiment of a chair chassis according to the present invention.
Figure 3:
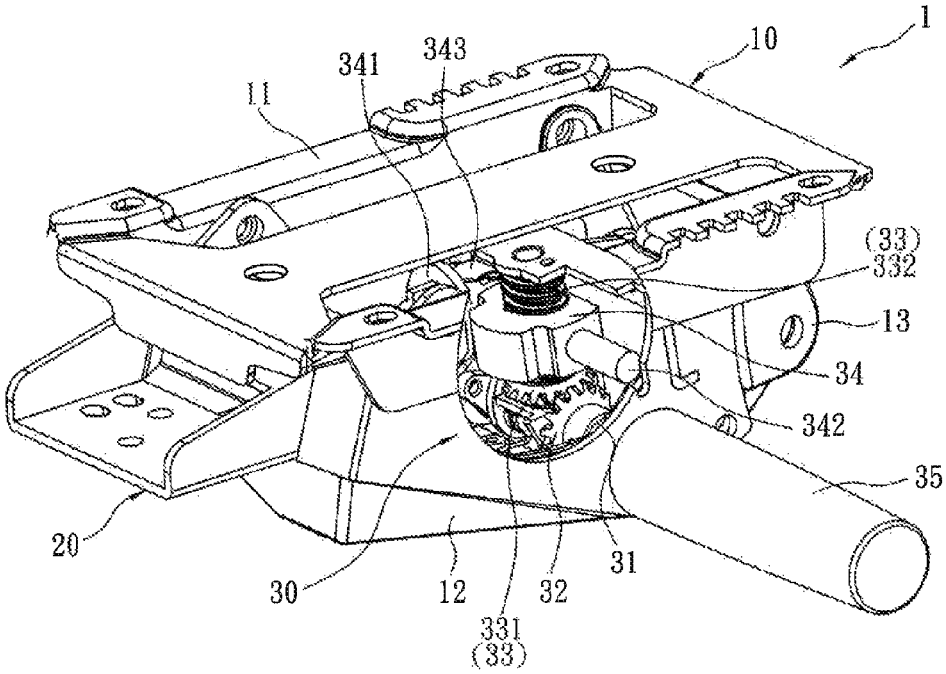
FIG. 3 is a perspective view of an embodiment of a chair chassis viewed from a left side according to the present invention.
Figure 4:
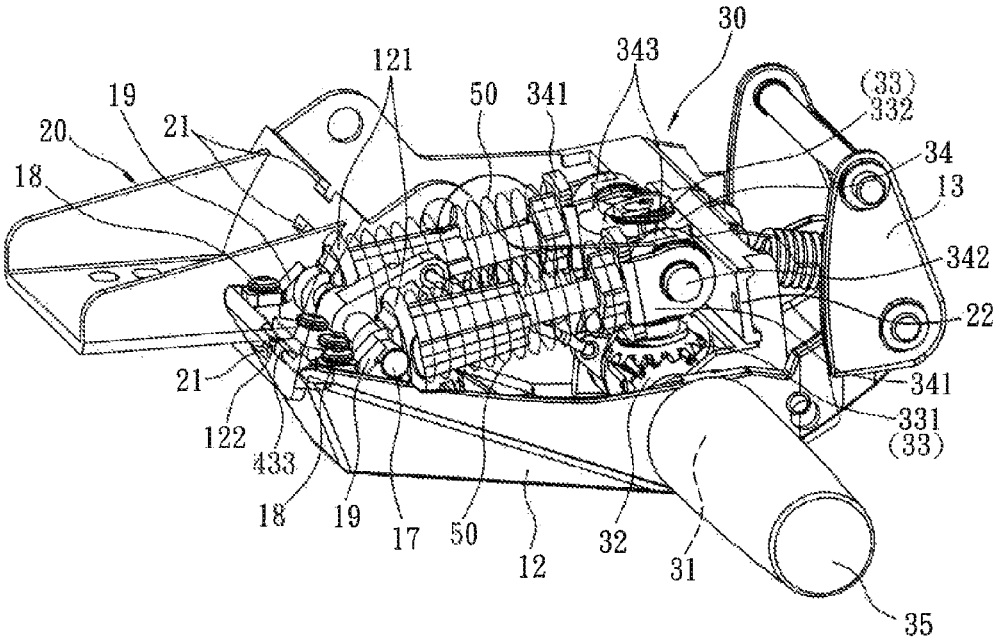
FIG. 4 is a perspective view of an embodiment of a chair chassis after an upper cover being removed from a base and viewed from a left side according to the present invention.

Refer from FIG. 1 and FIG. 2, a chair chassis 1 of the present invention includes a base 10, a warped plate 20, a first adjustment member 30 and a second adjustment member 40.

The base 10 is used for being fixed on a bottom surface of a seat 61 of a chair 60. The base 10 consists of an upper cover 11, a lower cover 12 and a front cover 13. The upper cover 11 is connected to the bottom surface of the seat 61 and the lower cover 12 is located under the upper cover 11 and connected to legs 62 of the chair 60. An upper end and a lower end of the front cover 13 are respectively connected to the front end of the upper cover 11 and the front end of the lower cover 12 by a first connecting shaft 14 and a second connecting shaft 15.

A rear end of the warped plate 20 is connected to the bottom end of a seat back 63 of the chair 60 and is located under the upper cover 11 of the base 10. A top end of the warped plate 20 is connected to the rear end of the upper cover 11 by a third connecting shaft 16.

Refer from FIG. 3 to FIG. 6, two compression springs 50 respectively arranged in parallel with a certain interval are disposed between the first adjustment member 30 and the warped plate 20. The two compression spring 50 are titled and mounted in the base 10. The first adjustment member 30 is composed of a first adjustment shaft 31, a drive wheel 32, a driven wheel 33 and an adjustment nut 34. An inner end of the first adjustment shaft 31 is inserted into the base 10 from the left side or right side of the base 10 through the corresponding side surfaces of the lower cover 12 of the base 10 and the warped plate 20. An outer end of the first adjustment shaft 31 is connected to a first handle 35 while the drive wheel 32 is connected to the inner end of the first adjustment shaft 31 and is driven to move (such as rotate) by the first adjustment shaft 31. The driven wheel 33 includes a gear part 331 and a screw shaft part 332 projecting and extending from a top surface of the gear part 331. The gear part 331 is engaged with the drive wheel 32. A top end of the screw shaft part 332 is tilted toward the warped plate 20 at a preset angle. The adjustment nut 34 is threaded around the screw shaft part 332 of the driven wheel 33. The left side and the right side of the adjustment nut 34 are respectively disposed with a first spring seat 341 symmetrically. The two first spring seats 341 are respectively against one end of the two compression springs 50 while the other end of the two compression springs 50 respectively are against each of two second spring seats 121 disposed on rear end of the lower cover 12 of the base 10. The two second spring seats 121 are penetrated and connected by a fourth connecting shaft 17. Each of two ends of the fourth connecting shaft 17 are fixed on the lower cover 12 by a press block 19 threaded with a screw 18. A pin shaft 342 is arranged at a left end and a right end of the adjustment nut 34. A roller 343 and the first spring seat 341 are set around the pin shaft 342. The roller 343 is in contact with a U-shaped piece 22 arranged at the warped plate 20. The travel distance of the compression spring 50 is adjusted by operation of the first adjustment member 30. The adjustment of the compression of the compression spring 50 can change the force of the seat back.

The drive wheel 32 and the gear part 331 of the driven wheel 33 can be bevel gears. The disposition of the drive wheel 32 and the driven wheel 33 converts horizontal transmission into vertical transmission so as to improve transmission efficiency. The screw shaft part 332 of the driven wheel 33 is with two-start left-hand trapezoidal threads while the number of screw turns of the screw shaft part 332 for adjustment is two and the number of screw turns of the driven wheel 33 for adjustment is no more than 2. These allow the adjustment faster and smoother.

Figure 5:
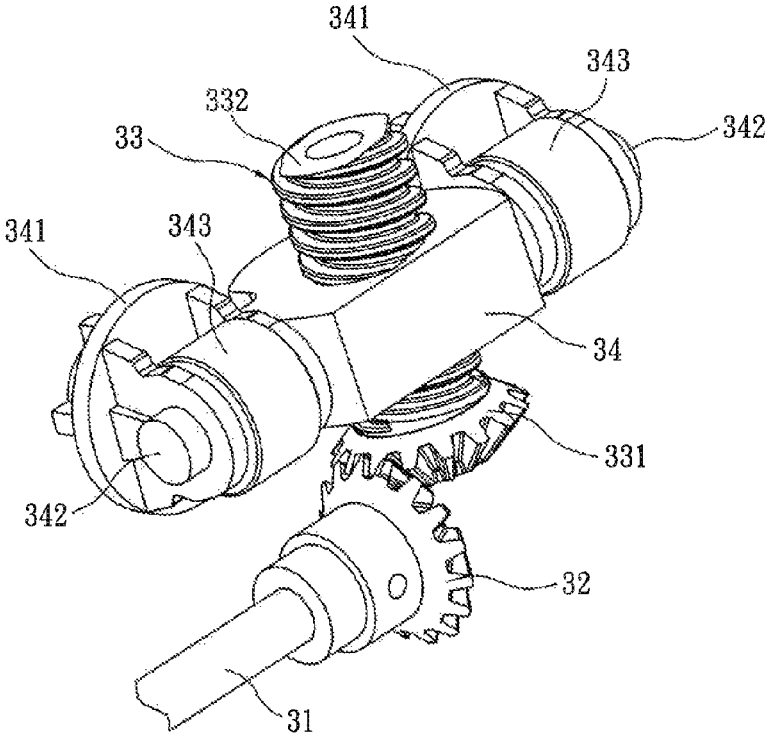
FIG. 5 is a partial enlarged view of the embodiment in FIG. 4.
Figure 6:
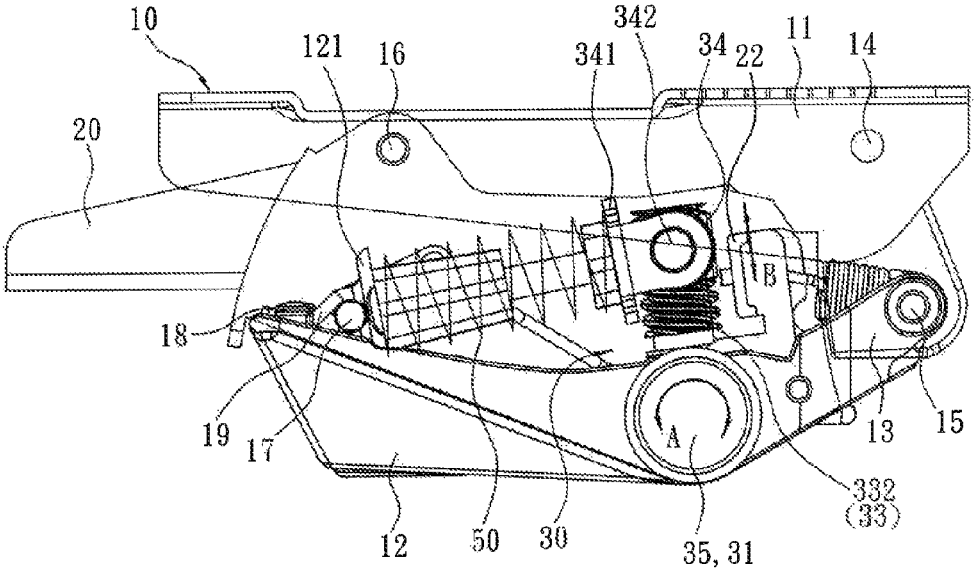
FIG. 6 is a cross sectional view of the embodiment in FIG. 2 viewed from a left side according to the present invention.

While adjusting the magnitude of the force of the seat back, as shown in FIG. 5 and FIG. 6, the warped plate 20 keeps still. Rotate the first handle 35 of the first adjustment member 30 (the arrow A indicates in FIG. 6) for driving the first adjustment shaft 31 and the drive wheel 32 to rotate. Thus the driven wheel 33 is further driven to rotate. That means the gear part 331 and the screw shaft part 332 of the driven wheel 33 are driven to rotate. The rotation of the screw shaft part 332 makes the adjustment nut 34 move along the screw shaft part 332 inclined and vertically (the arrow B indicates in FIG. 6). Thus the two compression springs 50 are moved vertically around the fourth connecting shaft 17 that is used as a fulcrum. Then the compression spring 50 is compressed or stretched so as to change the travel distance of the compression springs 50. Therefore the spring force of the compression springs 50 is adjusted and the adjustment of the force of the seat back is also achieved. The travel distance of the compression spring 50 changes along with different inclined angle of the screw shaft part 332. When the adjustment nut 34 is moved vertically, the roller 343 is rolling vertically along the U-shaped piece 22 of the warped plate 20. Besides a support function, the roller 343 also makes the vertical movement of the compression spring 50 more labor saving.

Figure 7:
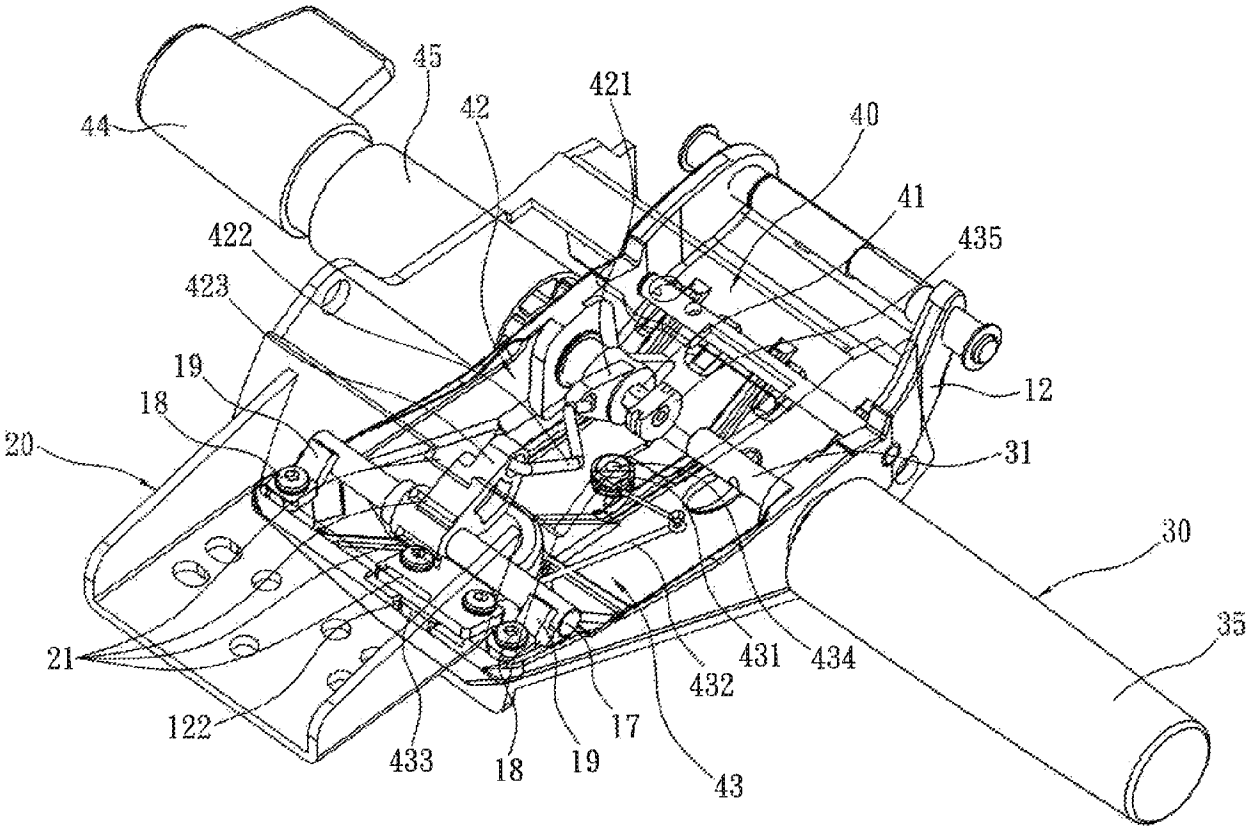
FIG. 7 is a perspective view of an embodiment of a chair chassis after an upper cover being removed from a base and viewed from a top side according to the present invention.
Figure 8:
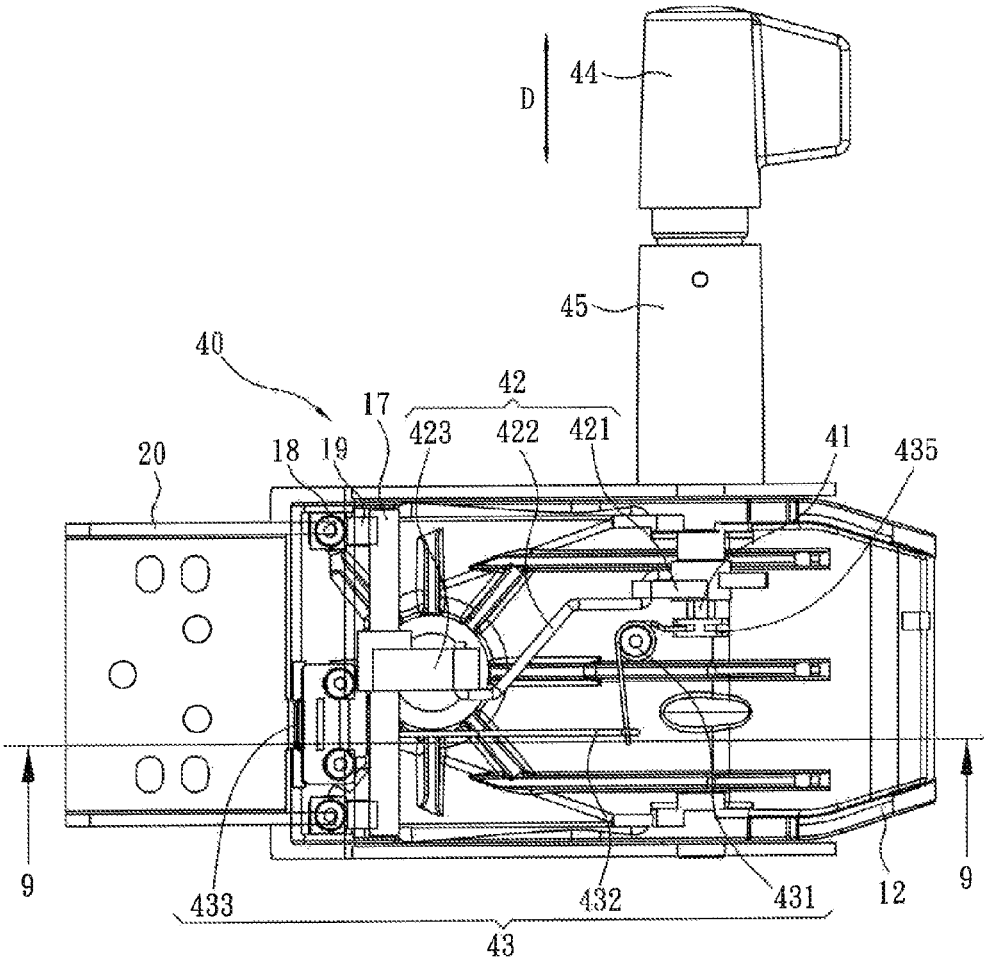
FIG. 8 is a schematic drawing showing a partial top view of the embodiment in FIG. 7 according to the present invention.
Figure 9:
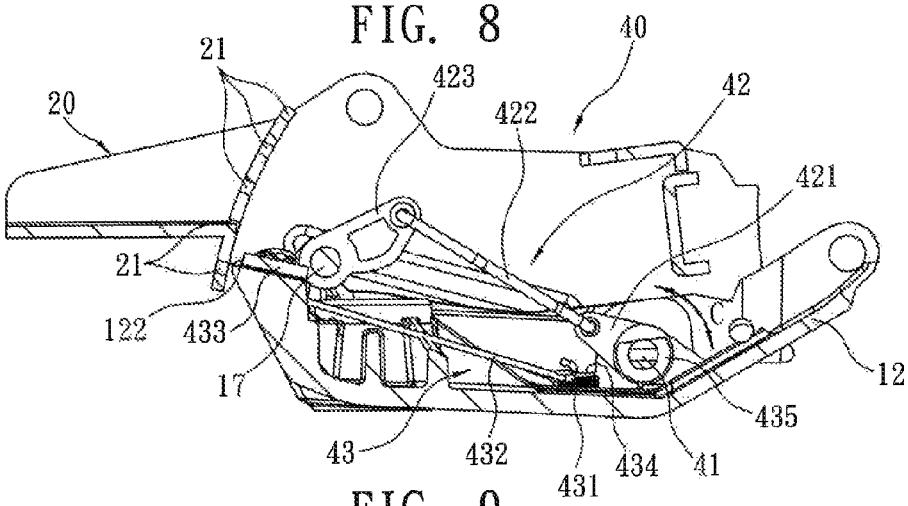
FIG. 9 is a cross sectional view along a 9-9 line of the embodiment in FIG. 8.

Refer from FIG. 7 to FIG. 9, the second adjustment member 40 consists of a second adjustment shaft 41, a lift adjustment part 42, and a range adjustment part 43. An inner end of the second adjustment shaft 41 is inserted through one side of the base 10 opposite to the side disposed with the first adjustment shaft 31 of the first adjustment member 30, from outside to inside, passing through the lower cover 12 of the base 10 and the corresponding side of the warped plate 20. An outer end of the second adjustment shaft 41 is connected to a second handle 44. A part of the second adjustment shaft 41 between the second handle 44 and the warped plate 20 is wrapped by a second handle positioning sleeve 45.

The lift adjustment member 42 includes a lift adjustment block 421, a lift pull rod 422 and a lift block 423. The lift adjustment block 421 is sleeved on the inner end of the second adjustment shaft 41 while the two ends of the lift pull rod 422 are respectively connected to the lift adjustment block 421 and the lift block 423. The lift block 423 is inserted through by the fourth connecting shaft 17 and is rotated around the fourth connecting shaft 17. Both the lift block 423 and the two second spring seats 121 are positioned on the lower cover 12 by the fourth connecting shaft 17.

The range adjustment part 43 is composed of a torsion spring 431, a pull rod 432 and a fastening piece 433. The torsion spring 431 is fastened and fixed on the lower cover 12 of the base 10 by a fastener 434 such as locking screw while two ends of the torsion spring 431 are respectively connected to an inner end of the second adjustment shaft 41 and one end of the pull rod 432. The other end of the pull rod 432 is connected to the fastening piece 433. A through hole 122 is disposed on a rear end of the lower cover 12 of the base 10, corresponding to the fastening piece 433 so as to allow the fastening piece 433 inserting through the through hole 122. Moreover, the warped plate 20 is disposed with a plurality of insertion holes 21 arranged at intervals vertically. One of the insertion holes 21 is corresponding to the through hole 122 on the lower cover 12 of the base 10 so that the fastening piece 433 is moved out and in one of the insertion hole 21 through the trough hole 122. When the fastening piece 433 is moved into and locked by the insertion hole 21 of the warped plate 20, this is the fastened state. When the fastening piece 433 is moved into and separated from the insertion hole 21 of the warped plate 20, it's in the released state. Furthermore, the inner end of the second adjustment shaft 41 is sleeved with a connector 435 so as to be connected to the torsion spring 431 by the connector 435.

The adjustment of lift range and fastening position of the chair chassis 1 is respectively made by operating the second adjustment member 40 such as rotating and pulling.

The cross section of the second adjustment shaft 41 can be a circle or a polygon. The polygon structure is more stable than the circle. Thus the second handle 44 in the polygon shape will not rotate freely and will not have trouble in use.

The torsion Spring 431 of the range adjustment member 43 makes the movement of the fastening piece 433 driven by the pull rod 432 become labor saving because there is less friction.

The number of the insertion holes 21 on the warped plate 20 is the number of ranges for adjustment between the fastening piece 433 and the insertion hole 21.

While adjusting the height of the chair, refer to FIG. 8 and FIG. 9, the lower plate 12 of the base 10 remains still. Rotate the second handle 44 of the second adjustment member 40 (the arrow C indicates in FIG. 9) to drive the second adjustment shaft 41 and the lift adjustment block 421 of the lift adjustment member 42 to rotate. Moreover, the lift block 423 is also driven to rotate around the fourth connecting shaft 17 through the lift pull rod 422 so as to perform the lift adjustment of the chair chassis. Due to the rotation, the lift block 423 is pressed on a head of a gas lift of the chair 60 for adjusting vertical height For adjusting the fastening position, as shown in FIG. 8 and FIG. 9, the lower cover 12 of the base 10 remains still. Operate the second handle 44 of the second adjustment member 40 to move outward or inward (the arrow D indicates in FIG. 8) for driving the second adjustment shaft 41 to move along the axial direction. Thus the torsion spring 431 is rotated to move the pull rod 432 and make the fastening piece 433 move out of/or into the insertion hole 21 of the warped plate 20. When the second handle 44 of the second adjustment member 40 is operated to be moved outward, the fastening piece 433 is moved out of one of the insertion holes 21 and the warped plate 20 is in a released state. Then the second handle 44 of the second adjustment member 40 is operated to be moved inward. At the moment, the fastening piece 433 is moved in another insertion hole 21 and the warped plate 20 is in a fastened state. Thus the adjustment of the fastening position and the adjustment of the range of the chair chassis have been completed. There is no noise generated during the adjustment processes of fastening and loosening of the present invention. The noise generated during tightening of the braking piece for inclining the conventional chair chassis can be avoided.

In summary, the travel distance/the elastic force of the compression spring 50 in the base 10 can be adjusted to increase the applicability. Moreover, the vertical adjustment and the fastening of the chair chassis are both operated by the same handle. Thus the structure is simplified and the adjustment is more convenient. While operating and inclining the chair chassis, the noises generated due to friction of the braking piece being fastened can be reduced. A recovery force is provided between the fastening piece 433 and the warped plate 20 for protection of the chair chassis. That means the fastening piece 433 will not return back to the original position immediately while the chair chassis is released from the fastened state. The fastening piece 433 and the warped plate 20 are not separated from each other at once. The fastening piece 433 and the warped plate 20 are separated after a force being applied to the seat back 63.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A chair chassis comprising:

a base being fixed on a bottom surface of a seat of a chair and having an upper cover connected to the bottom surface of the seat, a lower cover located under the upper cover and connected to a pedestal of the chair and a front cover whose upper end and lower end are respectively connected to a front end of the upper cover and a front end of the lower cover;

a warped plate that is located under the upper cover of the base and having a top end thereof connected to a rear end of the upper cover by a connecting shaft and a rear end thereof connected to a bottom end of a backrest of the chair;

two compression springs arranged in parallel with a certain interval, disposed between a first adjustment member and the warped plate, and located in the base; the first adjustment member having:

a first adjustment shaft whose inner end is inserted through one side of the base from outside to inside, through corresponding side surfaces of the lower cover of the base and the warped plate, and an outer end thereof is connected to a first handle;

a drive wheel that is connected to the inner end of the first adjustment shaft and is driven to rotate by the first adjustment shaft;

a driven wheel that includes a gear part engaged with the drive wheel and a screw shaft part projecting and extending from a top surface of the gear part; and an adjustment nut that is threaded around the screw shaft part of the driven wheel while a left side and a right side thereof are respectively disposed with a first spring seat symmetrically; each of the two first spring seats is against one end of each of the two compression springs; the other end of each of the two compression springs is against and located on a rear end of the lower cover of the base;

a second adjustment member having a second adjustment shaft whose inner end is inserted through one side of the base opposite to the side of the base disposed with the first adjustment shaft of the first adjustment member, from outside to inside, passing through the lower cover of the base and a corresponding side of the warped plate while an outer end thereof is connected to a second handle;

a lift adjustment member having a lift adjustment block, a lift pull rod and a lift block; wherein the lift adjustment block is sleeved on the inner end of the second adjustment shaft; two ends of the lift pull rod are respectively connected to the lift adjustment block and the lift block; the lift block is inserted through by another connecting shaft and is rotated around the connecting shaft; the connecting shaft inserted through the lift block is fixed on the lower cover; and a tilt adjustment part for adjusting the tilt of the backrest of the chair, the tilt adjustment part having a torsion spring, a pull rod and a fastening piece; the torsion spring is fastened and fixed on the lower cover of the base by a fastener while two ends of the torsion spring are respectively connected to an inner end of the second adjustment shaft and one end of the pull rod; the other end of the pull rod is connected to the fastening piece; the warped plate is disposed with a plurality of insertion holes arranged at intervals vertically and corresponding to the fastening piece and one of the insertion holes allows the fastening piece to move into or out of the insertion hole;

wherein the warped plate remains still while adjusting force to tilt the backrest of the chair; the first handle of the first adjustment member is rotated for driving the first adjustment shaft and the drive wheel to rotate synchronously and driving the driven wheel to rotate; thus the adjustment nut is moved along the screw shaft part of the driven wheel vertically to compress or stretch the compression springs and change travel distance of the compression springs for adjusting a spring force of the compression springs and further completing adjustment of the force to tilt the backrest of the chair;

while lifting the chair, the lower plate of the base remains still and the second handle of the second adjustment member is rotated to drive the second adjustment shaft and the lift adjustment block of the lift adjustment member to rotate; then the lift block is driven to rotate around the connecting shaft of the lift adjustment member through the lift pull rod so as to allow a height adjust member to adjust height of the chair;

while adjusting a fastening position of the backrest of the chair, the lower cover of the base remains still and the second handle of the second adjustment member is operated to move outward or inward for driving the second adjustment shaft to move along an axial direction, rotating the torsion spring and driving the pull rod so as to make the fastening piece move out of or in one of the insertion holes of the warped plate; the warped plate is in a released state when the fastening piece is moved out of one of the insertion holes; the warped plate is in a fastened state while the fastening piece being moved into one of the insertion holes.

2. The device as claimed in claim 1, wherein the upper end and the lower end of the front cover are respectively connected to the front end of the upper cover and the front end of the lower cover by two connecting shafts.

3. The device as claimed in claim 1, wherein two second spring seats are disposed on the rear end of the lower cover of the base; one end of each of the compression springs is against the first spring seat of the adjustment nut while the other end of each of the compression springs is against the second spring seat; the second spring seats are penetrated and connected by the connecting shaft of the lift adjustment member so that the lift block and the second spring seats share the connecting shaft of the lift adjustment member.

4. The device as claimed in claim 1, wherein the connecting shaft of the lift adjustment member is fixed on the lower cover by two press blocks each of which is threaded with a screw.

5. The device as claimed in claim 1, wherein a pin shaft is arranged at a left end and a right end of the adjustment nut; a roller and the first spring seat are set around the pin shaft; the roller is in contact with a U-shaped piece arranged at the warped plate.

6. The device as claimed in claim 1, wherein the drive wheel and the gear part of the driven wheel are bevel gears.

7. The device as claimed in claim 1, wherein the screw shaft part of the driven wheel is formed with two-start left-hand trapezoidal threads while the number of screw turns of the screw shaft part for adjustment is two.

8. The device as claimed in claim 1, wherein the inner end of the second adjustment shaft is sleeved with a connector so that the second adjustment shaft is connected to the torsion spring of the range adjustment part of the second adjustment member by the connector.

9. The device as claimed in claim 1, wherein a cross section of the second adjustment shaft of the second adjustment member is a circle or a polygon.

10. The device as claimed in claim 1, wherein the number of the insertion holes on the warped plate is the number of ranges for adjustment between the fastening piece and the insertion hole.

* * * * *